US011794053B1

(12) United States Patent
Woodyard, III

(10) Patent No.: US 11,794,053 B1
(45) Date of Patent: Oct. 24, 2023

(54) SYSTEM AND METHOD FOR FULL BODY ISOMETRIC MACHINE

(71) Applicant: Stephen H. Woodyard, III, Crofton, MD (US)

(72) Inventor: Stephen H. Woodyard, III, Crofton, MD (US)

( * ) Notice: Subject to any disclaimer, the term of this patent is extended or adjusted under 35 U.S.C. 154(b) by 0 days.

(21) Appl. No.: 18/121,175

(22) Filed: Mar. 14, 2023

(51) Int. Cl.

| | |
|---|---|
| ***A63B 21/002*** | (2006.01) |
| ***A63B 21/00*** | (2006.01) |
| ***A63B 21/005*** | (2006.01) |
| ***A63B 21/072*** | (2006.01) |
| ***A63B 24/00*** | (2006.01) |
| ***A63B 71/06*** | (2006.01) |

(52) U.S. Cl.
CPC ..... *A63B 21/0023* (2013.01); *A63B 21/0058* (2013.01); *A63B 21/0724* (2013.01); *A63B 21/151* (2013.01); *A63B 21/4035* (2015.10); *A63B 21/4045* (2015.10); *A63B 24/0087* (2013.01); *A63B 71/0622* (2013.01); *A63B 2024/0068* (2013.01); *A63B 2024/0093* (2013.01); *A63B 2220/803* (2013.01); *A63B 2220/833* (2013.01)

(58) Field of Classification Search
CPC ..... A63B 21/0023; A63B 21/4035; A63B 21/4045; A63B 21/0058; A63B 21/0724; A63B 21/151; A63B 24/0087; A63B 71/0622; A63B 2024/0068; A63B 2024/0093; A63B 2220/803; A63B 2220/833
See application file for complete search history.

(56) References Cited

U.S. PATENT DOCUMENTS

| | | | | |
|---|---|---|---|---|
| 3,465,592 | A * | 9/1969 | Perrine | A63B 21/4047 482/5 |
| 4,146,222 | A | 3/1979 | Hribar | |
| 5,577,981 | A | 11/1996 | Jarvik | |
| 5,658,226 | A | 8/1997 | Mentz | |
| 8,337,372 | B1 | 12/2012 | Boterenbrood | |
| 8,636,626 | B2 | 1/2014 | Diaz | |
| 8,734,301 | B2 | 5/2014 | Remelius | |
| 9,220,940 | B2 | 12/2015 | Al Kuwari | |
| 9,433,817 | B2 | 9/2016 | Toback et al. | |
| 9,814,928 | B2 | 11/2017 | Taylor et al. | |
| 10,561,886 | B2 | 2/2020 | Bassoo | |
| 10,967,220 | B2 | 4/2021 | Gouzenko | |
| 11,007,392 | B2 | 5/2021 | Schlegel | |
| 11,273,343 | B2 | 3/2022 | Augustin et al. | |
| 11,311,447 | B2 | 4/2022 | Gordon et al. | |
| 2016/0287989 | A1 | 10/2016 | Fung | |
| 2017/0361165 | A1* | 12/2017 | Miller | A63B 21/00178 |

FOREIGN PATENT DOCUMENTS

| | | | | |
|---|---|---|---|---|
| DE | 202006019346 U1 * | 3/2007 | ..... | A63B 21/0603 |

* cited by examiner

*Primary Examiner* — Sundhara M Ganesan
*Assistant Examiner* — Jacqueline N L Loberiza
(74) *Attorney, Agent, or Firm* — Bold IP, PLLC; Christopher Mayle

(57) ABSTRACT

A system and method for an exercise apparatus that is an isometric full body exercise system whereby the isometric full body exercise system flooring has a sand pit section, variable resistance handles that extend outward from an apparatus at a center of the sand pit section for a user to move in a circular motion, and a video display screen that provides content related to an exercise regimen for the user to perform on the variable resistance handles.

20 Claims, 10 Drawing Sheets

SYSTEM AND METHOD FOR FULL BODY ISOMETRIC MACHINE

FIELD OF DISCLOSURE

The field of disclosure is generally directed to an exercise apparatus and more particularly for an exercise machine based on extreme isometric movements with full body movement.

BACKGROUND

Both diet and physical activity play a critical role in maintaining a healthy body weight, losing excess body weight, or maintaining successful weight loss. Exercise can have a profoundly positive impact on depression, anxiety, and ADHD. It also relieves stress, improves memory, helps you sleep better, and boosts your overall mood. It also increases heart rate, which pumps more oxygen to the brain. Exercise aids the release of hormones which provide an excellent environment for the growth of brain cells. Exercise also promotes brain plasticity by stimulating growth of new connections between cells in many important cortical areas of the brain. There are a plurality of exercise apparatuses but none currently provide the movement that would be comparable to a real job which would allow the user to become "cock strong" and stronger than body builders or weightlifters. Thus exists the need for an exercise apparatus that is based on extreme isometric movements and allows for full body movement.

SUMMARY

The embodiments of the present invention are directed to a system and method that is a full body exercise system that is comparable to when you play volleyball at the beach. Every small muscle group in your body, in this case your feet, legs, and torso, compensates for the insecure footing when positioned on the sand. The system and method provides a full body isometric exercise machine focusing on the body's small muscle groups which, as they get stronger, enables the large muscle groups to get abnormally stronger faster. The key component is standing in a sand or simulated sand platform while moving extreme weight forward and backwards after visualizing the moves on a display.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

In the Summary above and in this Detailed Description, and the claims below, and in the accompanying drawings, reference is made to particular features of the invention. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure is generally drawn to a system and method, according to one or more exemplary embodiments, for an exercise apparatus that is an isometric full body exercise system. The isometric full body exercise system flooring has a sand pit section, variable resistance handles that extend outward from an apparatus, a center of the sand pit section extends for a user to move in a circular motion, and a video display screen that provides content related to an exercise regimen for the user to perform on the variable resistance handles.

The full body exercise machine is designed to be used similar to a ladle in metallurgy. Typically, a ladle is used transporting and pouring molten metal from a furnace into a mold or ingot mold. It is a long-handled spoon-like vessel with a deep bowl, typically made of cast iron or steel. The handle is insulated to protect the user from the heat of the molten metal. Ladles are typically used in foundries and metal casting operations to pour molten metal into molds to produce castings. They are also used in steelmaking to transfer molten steel from the furnace to a tundish, which is a container used to hold the steel while it is being transferred to a mold or casting machine. Ladles can come in a variety of sizes depending on the volume of molten metal that needs to be poured. They are an essential tool in the metallurgical industry and are used in a wide range of applications. The operation of the ladle is a strenuous full body exercise for the user while manipulating the handle to pour the ladle which the present invention mimics.

Figure 1:
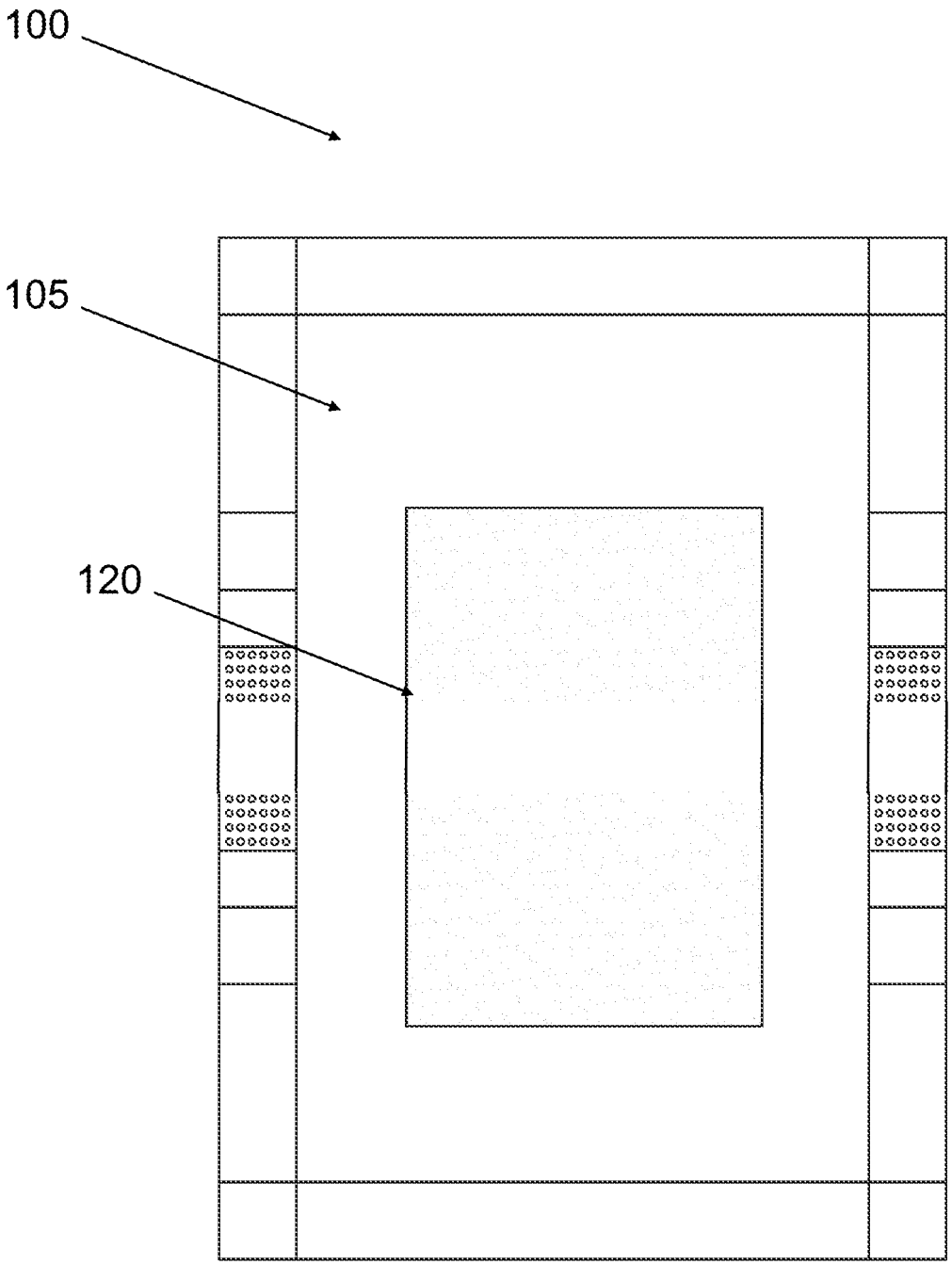
FIG. 1 illustrates a view of an embodiment of the full body isometric machine.

One embodiment of isometric full body exercise system 100, in accordance with the present invention is illustrated in FIG. 1. Full body exercise system 100 may have standing platform 105 with a base surface that extends upward into a series of sidewalls to create a cavity of which sand may be poured in for the user 101 to perform exercises on. Standing platform 105 may be divided into multiple sections by one or more intermediary walls for the users to exercise upon. Standing platform 105 may be based on where the components of full body exercise system 100 are placed, such as in the middle where standing platform 105 is divided into two parts on opposite sides. In one non-limiting embodiment, these two sections may be 4' by 5' to 6' area that is 24" to 30" deep filled with sand or other material that has the capability to simulate sand.

Figure 4:
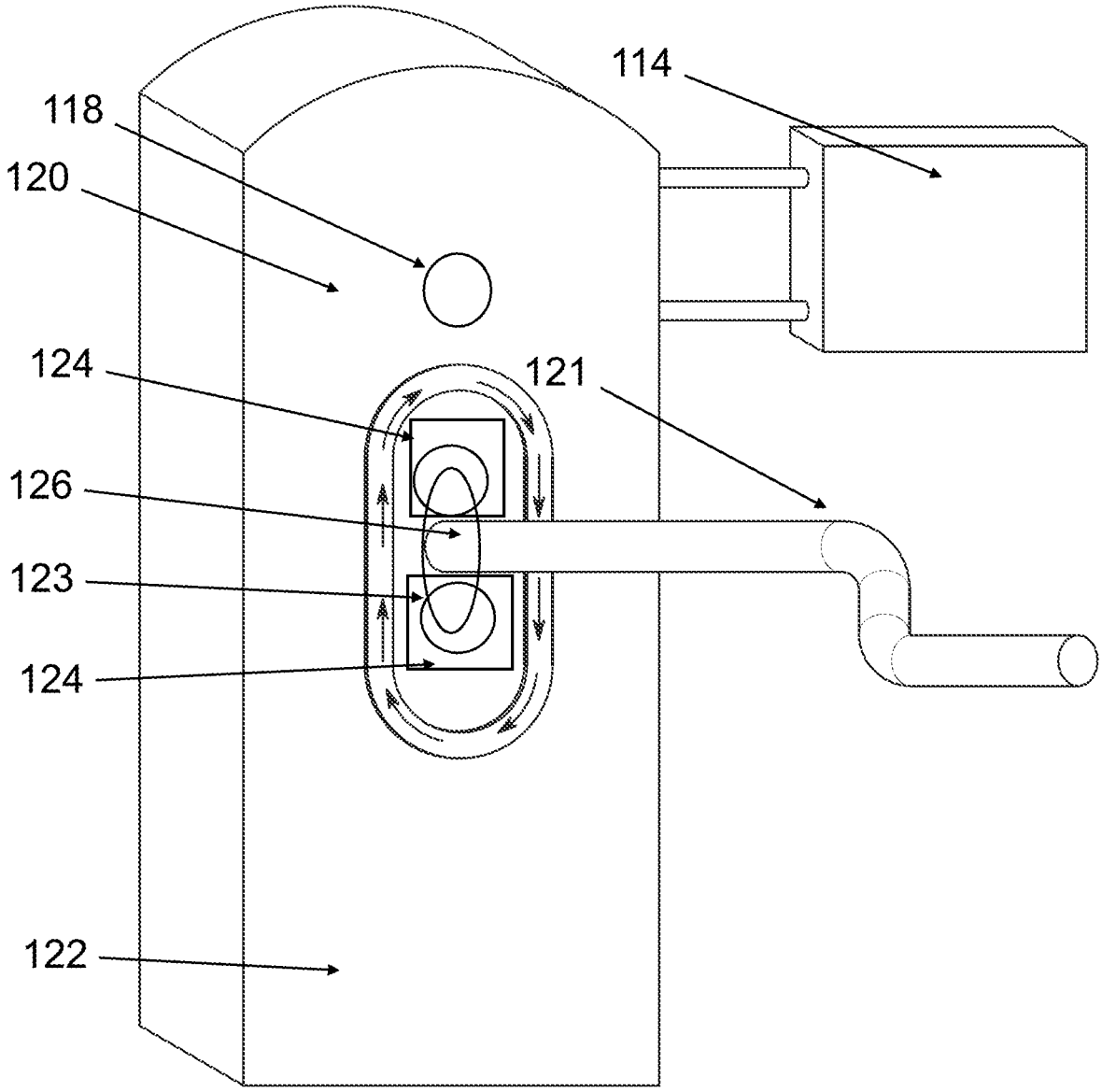
FIG. 4 illustrates the workout apparatus.
Figure 5:
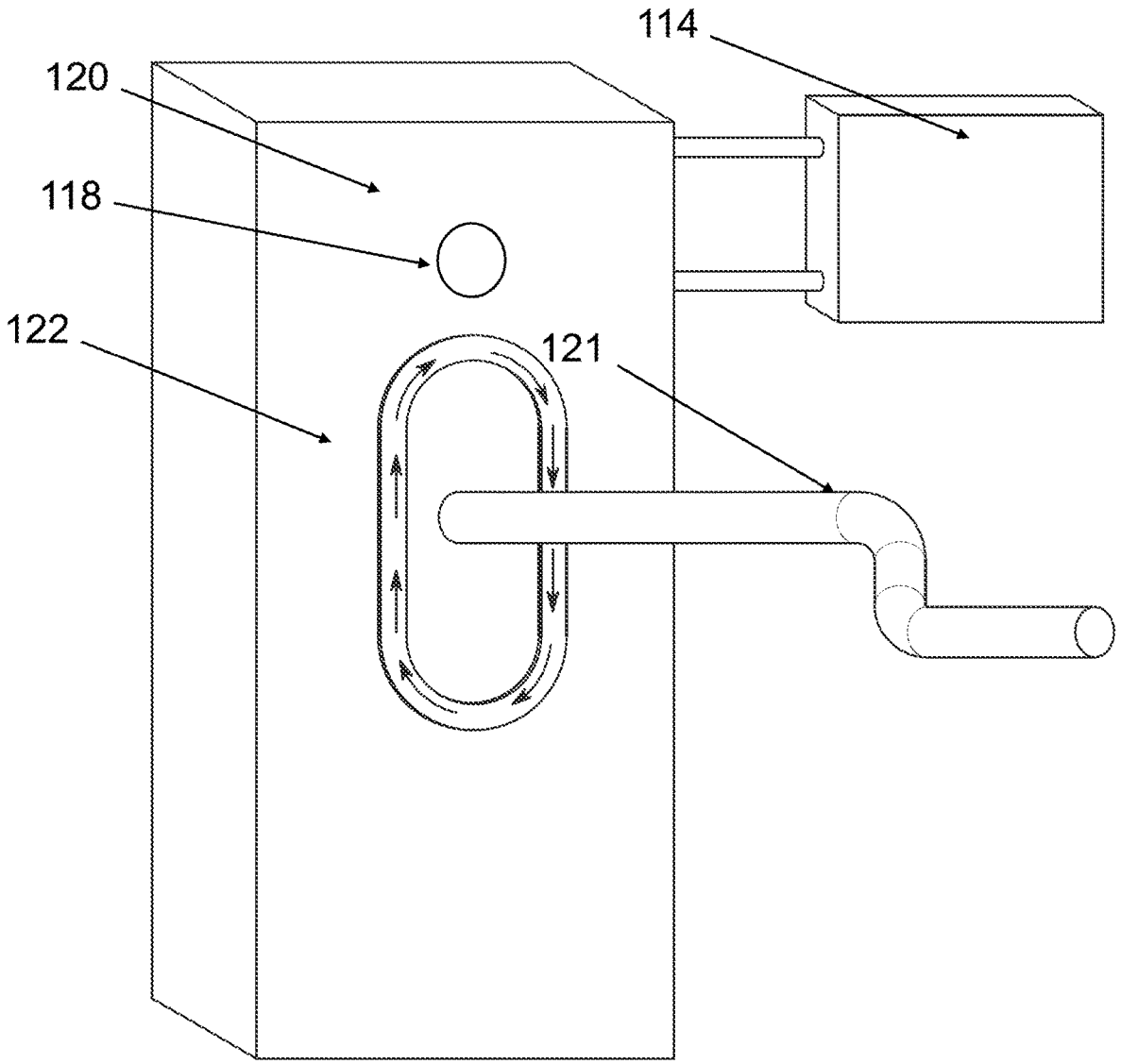
FIG. 5 illustrates another workout apparatus.

Full body exercise system 100 may include multiple removable or stationary components such as workout apparatus 120 which may be positioned at a center of standing platform 105 as illustrated in FIGS. 4 and 5. Workout apparatus 120 may be designed for various movements to perform various exercise motions. In one non-limiting embodiment, user 101 may perform these exercises by the user manipulating a handle 121 that extends from outside a body 122 where the handle 121 is connected to a cable 123 connected to a motor 124 to provide torque or tension to handle 121 such that the user may be provided resistance weight training while on the sand whereby motor 124 applies resistance similar to the pouring of a ladle in metallurgy.

Figure 8:
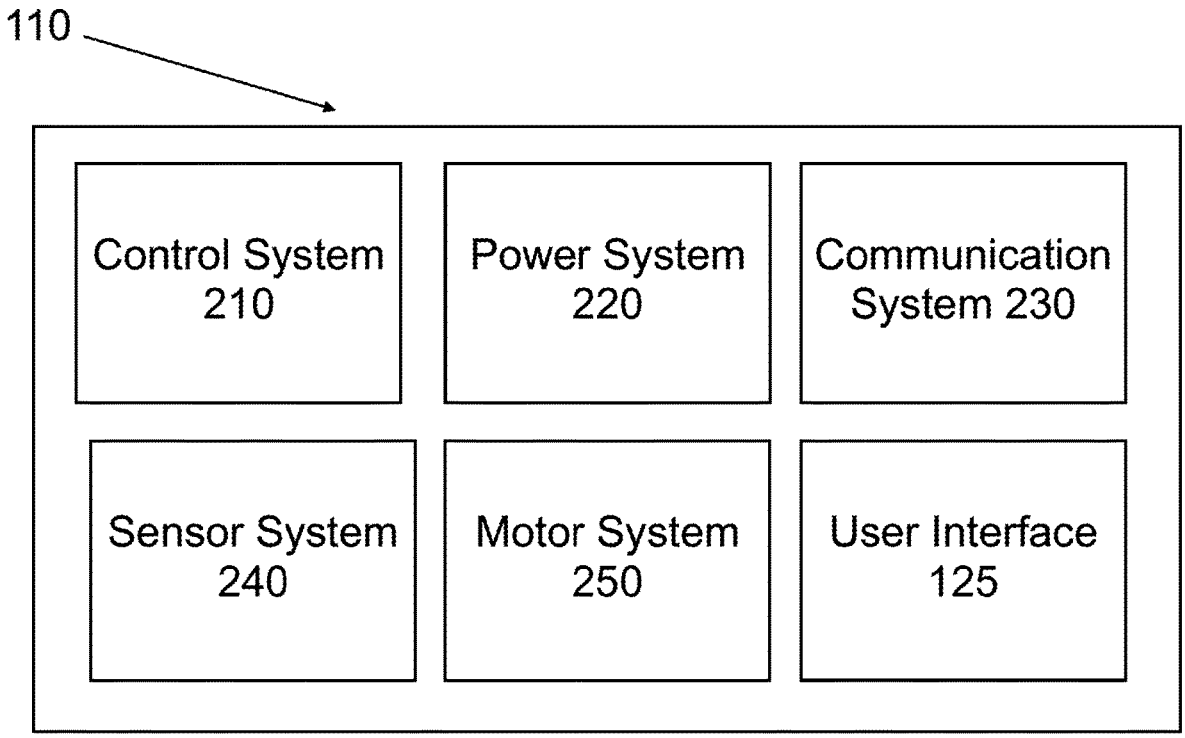
FIG. 8 illustrates the component systems of the full body isometric machine.

Full body exercise system 100 may have one or more computing devices 110, as illustrated in FIG. 8 which may be connected to the control panels. Computing devices 110 may have a plurality of systems including a control system such as control system 210, a power system such as power system 220, and a communication system such as communication system 230, a sensor system 240, and a motor system 250, which may be integrated in combination within the structure of computing device 110. The various systems may be individually configured and correlated with respect to each other so as to attain the desired objective of providing an interactive computing device 110 for the users through the control panels and display.

Power system 220 of computing device 110 may provide the energy to computing device 110 including the circuits and components of control system 210 during operation of workout apparatus 120. Computing device 110 may be powered by methods known by those of ordinary skill in the art. In some embodiments, computing device 110 may plug into an electrical outlet using an electrical cord to supply power to computing device 110 and the circuits and components of control system 210. Further, power system 220 may include a rechargeable battery pack whereby the rechargeable battery is of a charge, design, and capacity to provide sufficient power to computing device 110 and the circuits and components of control system 210 while running workout apparatus 120 and other various components of full body exercise system 100 for a set period of time.

Control system 210 may operate to control the actuation of the other systems. Control system 210 may have a series of computing systems. Control system 210 may be in the form of a circuit board, a memory or other non-transient storage medium in which computer-readable coded instructions are stored, and one or more processors configured to execute the instructions stored in the memory. Control system 210 may have a wireless transmitter, a wireless receiver, and a related computer process executing on the processors. Computing systems of control system 210 may be any type of computing systems that typically operates under the control of one or more operating systems which control scheduling of tasks and access to system resources.

The one or more computing systems may be integrated directly into control system 210, while in other non-limiting embodiments, control system 210 may be a remotely located user computing device or server configured to communicate with one or more other control systems 210 in computing devices 110. Control system 210 may also include an internet connection, network connection, and/or other wired or wireless means of communication (e.g., LAN, etc.) to interact with other components. These connections allow the users to update, control, send/retrieve information, monitor, or otherwise interact passively or actively with control system 210.

Control system 210 may include control circuitry and one or more microprocessors or controllers acting as a servo control mechanism capable of receiving input from various components of computing device 110 as well communication system 230, analyzing the input from the components and communication system 230, and generating an output signal to the various components and communication system 230. The microprocessors (not shown) may have onboard memory to control the power that is applied to the various components, power system 220, and communication system 230, in response to input signals from the users and the various components of workout apparatus 120.

Control system 210 may maintain one or more databases. Control system 210 may receive and store data constituting images (e.g., still and/or moving video and/or graphical images) that may be displayed on a display 270 of computing devices. Computing device 110 may include local wireless circuitry which would enable short-range communication to another user computing device as well as Bluetooth sensors and NFC chips. The local wireless circuitry may communicate on any wireless protocol, such as infrared, Bluetooth, IEEE 802.11, or other local wireless communication protocol.

Computing device 110 may have one or more communication ports coupled to the circuitry to enable a wired communication link to another device, such as but not limited to another wireless communications device including a laptop or desktop computer, television, video console, speaker, smart speaker, or voice assistant such as Alexa Echo®. The communication link may enable communication between Computing device 110 and other devices by way of any wired communication protocol, such as USB wired protocol, RS-232, or some proprietary protocol. Computing device 110 may have a global positioning system (GPS) unit coupled to the circuitry to provide location information to the circuitry whereby the GPS may provide the location information related to the location of computing device 110 as known by those of ordinary skill in the art.

Computing device 110 may communicate with other devices via communication links, such as USB (Universal Serial Bus) or HDMI/VGA (High-Definition Multimedia Interface/Video Graphics Array). Computing device 110 may include voice recognition capable software that may be used to navigate or issue instructions as well as fingerprint recognition software, optical scanners, optical pointers, digital image capture devices, and associated interpretation software. Computing device 110 may utilize additional Input Devices 265 and Other I/O 275 in the form of examples such as a speaker, smart speaker, microphone, headphone jack, indicator lights, and vibrational motor.

Workout apparatus 120 may include one or more control panels 114 that are touch panel displays that extend from the main body of workout apparatus 120 where the users may visualize the exercises they need to perform with their body, handle 121, or other accessories. Control panels 114 may also have cover glass bonded to a top surface of a touch panel using adhesive or any other fastening methods known by those of ordinary skill in the art. Control Panels may have any number of covers to protect control panels 114 from elements such as the weather.

Control panels 114 may have capacitive sense capabilities, whereby when users 101 touch the touch panel, properties of the charged touch panel are altered in that spot, thus registering where control panel 114 was touched allowing the user to navigate through programs, routines, and exercise to perform. Control panel 114 may also be receptive to a stylus made of a conductive wire or other material configured to transmit an electrical signal necessary to register the contact. Control panel 114 may have resistive sense capabilities whereby a touch panel may have two conductive layers layered inside the surface of control panel 114 whereby when users 101 press down on the touch panel, the two layers come in contact, completing a circuit and sending a signal of where control panel 114 was touched. The control panel 114 may also include haptic feedback, for example, to inform user 101 of certain events. Haptic feedback may be provided through the entire touch screen display or may be local to a particular location on the touch screen display.

Control panel 114 may include one or more buttons such as buttons along the exterior of the display including a power button for exiting and/or deactivating computing device 110. The buttons may be utilized as volume up and volume down buttons for increasing and decreasing the volume of the audio output and a home button and directional keys to navigate through one or more menus. These locations of buttons are merely for illustrative purposes and control panel 114 may feature a power control, volume control, and home control button on the front, back, and/or side of any components of the control panel.

Control panel 114 may have a connected speaker assembly that converts an electrical signal from control system 210 into an audible sound. The speaker may be mounted to the housing of computing device 110 such that audible sound from the speaker has access to the exterior of the housing of computing device 110 where it then may be heard in the surrounding area. Control system 210 may be connected to a speaker assembly or audio receiving element allowing for the passage of sound to be received by control system 210 to receive auditory signals from users 101 or a third party in proximity to computing device 110. Control system 210 may also have the necessary circuitry to amplify and convert the signal of microphone to speaker and to convert the signal from microphone to control system 210 whereby auditory signals may be digitized and sent to databases or server 300 through communication system 230 whereby auditory signals may be compressed, encrypted, or arranged. Auditory signals may later be transmitted back to computing device 110 whereby auditory signals may be decompressed and decrypted for storage and reproduction thereon.

Control system 210 may include circuitry to provide an actuable interface for user 101 to interact with, including switches and indicators and accompanying circuitry for control panel 114. Control system 210 may be preprogrammed with any reference values by any combination of hardwiring, software, or firmware to implement various operational modes.

Control system 210 may be in communication with communication system 230, as illustrated in FIG. 8 to connect with other user computing devices whereby signals transmitted from the user computing devices may be received by control system 210. Communication system 230 may allow the users to interact with control system 210 using computing devices 110 even if users 101 are not proximate to control system 210. Users 101 may access a user interface, such as user interface 125 using computing devices 110. User interface 125 may have a plurality of buttons or icons that are selectable by user 101 for communication system 230 to perform particular processes in response to the selections. User interface 125 may have conventional GUI interface devices such as a title bar, toolbars, pull-down menus, tabs, scroll bars, context help, dialog boxes, operating buttons (icons), and status bar that enable user navigation throughout the display.

In one or more non-limiting embodiments, communication system 230 may be innate, built into, or otherwise integrated into existing platforms or systems such as a website, a third party program, Apple™ operating systems (e.g., iOS), Android™, Snapchat™, Instagram™ Facebook™, or any other platform.

Figure 9:
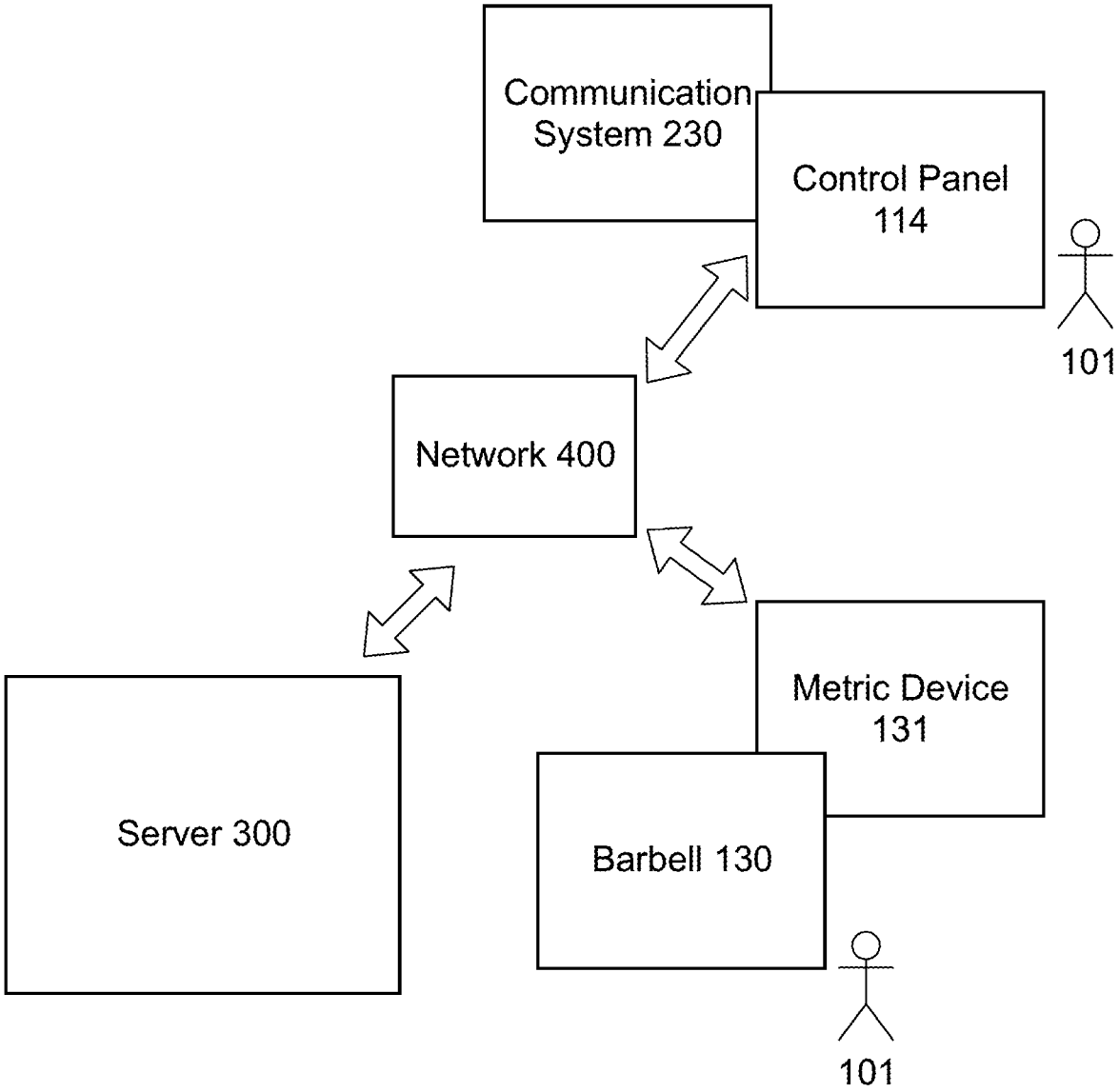
FIG. 9 illustrates the connected network for full body isometric machine.

In some embodiments, computing devices 110 may be in communication with one or more servers as illustrated in FIG. 9, such as server 300 via communication system 230 or one or more networks such as network 400 connected to communication system 230 whereby information may be presented similar to the display. Server 300 may be located at a data center or any other location suitable for providing service to network 400 whereby server 300 may be in one central location or in many different locations in multiple arrangements. Server 300 may comprise a database server such as MySQL® or Maria DB® server. Server 300 may have an attached data storage system storing software applications and data. Server 300 may have a number of modules that provide various functions related to communication system 230. Modules may be in the form of software or computer programs that interact with the operating system of server 300 whereby data collected in databases as instruction-based expressions of components and/or processes under communication system 230 may be processed by one or more processors within server 300 or another component of communication system 230 as well as in conjunction with execution of one or more other computer programs. Modules may be configured to receive commands or requests from computing devices 110, server 300, and outside connected devices over network 400. Server 300 may comprise components, subsystems, and modules to support one or more management services for communication system 230.

In one or more non-limiting embodiments, network 400 may include a local area network (LAN), such as a company Intranet, a metropolitan area network (MAN), or a wide area network (WAN), such as the Internet or World Wide Web. Network 400 may be a private network, a public network, or a combination thereof. Network 400 may be any type of network known in the art, including a telecommunications network, a wireless network (including Wi-Fi), and a wireline network. Network 400 may include mobile telephone networks utilizing any protocol or protocols used to communicate among mobile digital user computing devices (e.g., computing device 110), such as GSM, GPRS, UMTS, AMPS, TDMA, or CDMA. In one or more non-limiting embodiments, different types of data may be transmitted via network 400 via different protocols. In alternative embodiments, computing devices 110, may act as standalone devices or whereby they may operate as peer machines in a peer-to-peer (or distributed) network environment.

Network 400 may further include a system of terminals, gateways, and routers. Network 400 may employ one or more cellular access technologies including 2nd (2G), 3rd (3G), 4th (4G), 5th (5G), LTE, Global System for Mobil communication (GSM), General Packet Radio Services (GPRS), Enhanced Data GSM Environment (EDGE), and other access technologies that may provide for broader coverage between user computing devices if, for instance, they are in a remote location not accessible by other networks.

Figure 10:
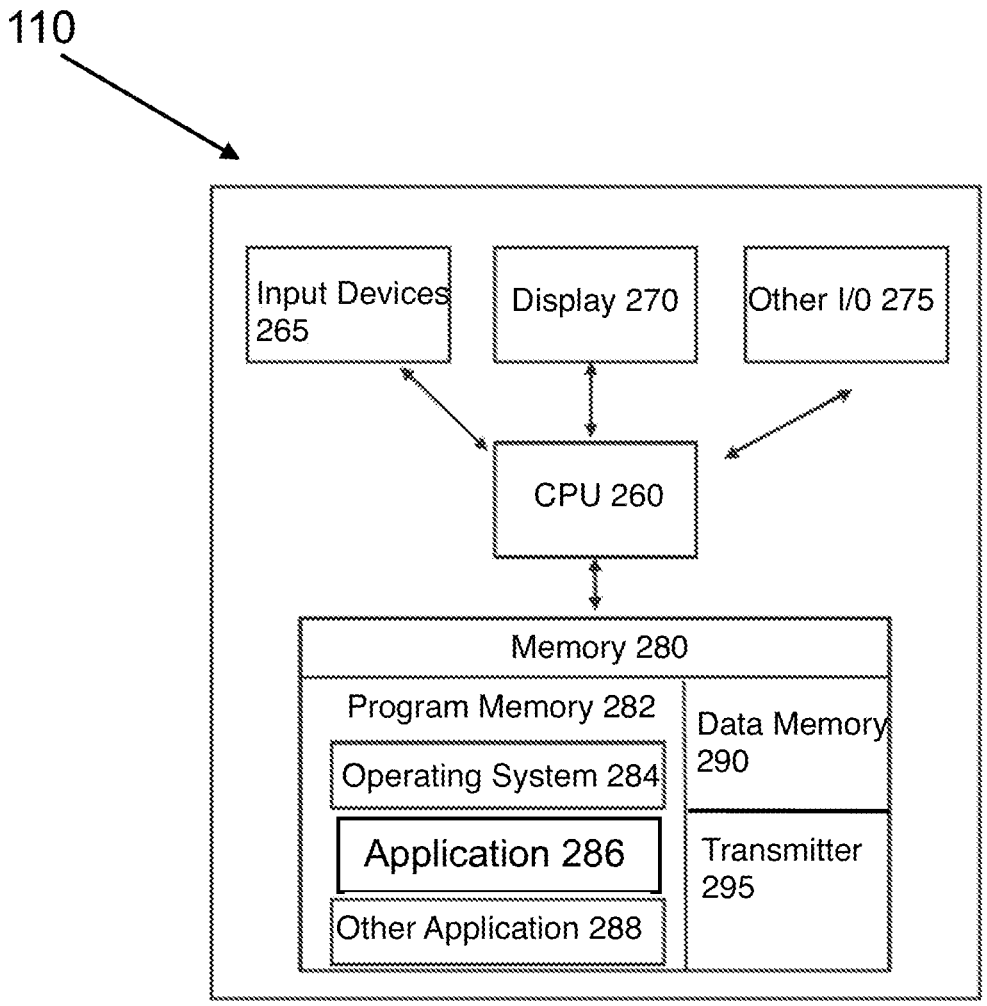
FIG. 10 illustrates a sample computing device.

Turning to FIG. 10, FIG. 10 is a block diagram showing various components of one embodiment of a computing device 110. Computing device 110 may comprise a housing for containing one or more hardware components that allow access to edit and query communication system 230. Computing device 110 may include one or more input devices such as input devices 265 that provide input to a CPU (processor) such as CPU 260 of actions related to user 101.

Input devices 265 may be implemented as a keyboard, a touchscreen, a mouse, via voice activation, a wearable input device, a camera a trackball, a microphone, a fingerprint reader, an infrared port, a controller, a remote control, a fax machine, and combinations thereof.

The actions may be initiated by a hardware controller that interprets the signals received from input device 265 and communicates the information to CPU 260 using a communication protocol. CPU 260 may be a single processing unit or multiple processing units in a device or distributed across multiple devices. CPU 260 may be coupled to other hardware devices, such as one or more memory devices with the use of a bus, such as a PCI bus or SCSI bus. CPU 260 may communicate with a hardware controller for devices.

Other I/O devices such as I/O devices 275 may also be coupled to the processor, such as a network card, video card, audio card, USB, FireWire or other external device, camera, printer, speakers, CD-ROM drive, DVD drive, disk drive, or Blu-Ray device. In further non-limiting embodiments, a display may be used as an output device, such as, but not limited to, a computer monitor, a speaker, a television, a smart phone, a fax machine, a printer, or combinations thereof.

CPU 260 may have access to a memory such as memory 280. Memory 280 may include one or more of various hardware devices for volatile and non-volatile storage and may include both read-only and writable memory. For example, memory 280 may comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. Memory 280 may be a non-transitory memory.

Memory 280 may include program memory such as program memory 282 capable of storing programs and software, including an operating system, such as operating system 284. Memory 280 may further include an application programing interface (API), such as API 286, and other computerized programs or application programs such as application programs 288. Memory 280 may also include data memory such as data memory 290 that may include database query results, configuration data, settings, user options, user preferences, or other types of data, which may be provided to program memory 282 or any element of computing device 110.

Computing device 110 may have a transmitter 295, such as transmitter 295, to transmit biological data or biometrics identified by sensors. Transmitter 295 may have a wired or wireless connection and may comprise a multi-band cellular transmitter to connect to the server 300 over 2G/3G/4G/5G cellular networks. Other embodiments may also utilize Near Field Communication (NFC), Bluetooth, or another method to communicate information.

Workout apparatus 120 and/or full body exercise system 100 may include a sensor system 240 with one or more detectors mounted or otherwise connected to the housing of workout apparatus 120 or other components of full body exercise system 100. Workout apparatus 120 may have infrared ("IR") detectors having photodiode and related amplification and detection circuitry to sense the presence of people in the room or location or connected devices. In other embodiments, computing device 110 may include radio frequencies, magnetic fields, and ultrasonic sensors. Detectors may be arranged in any number of configurations and arrangements on the housing of computing device 110.

In some non-limiting embodiments, sensor system 240 may include a user tension sensor; a torque/tension/strain sensor and/or gauge to measure how much tension/force is being applied to the handle by the user. In one embodiment, a tension sensor is built into a cable connected to a motor. Alternatively, a strain gauge is built into a motor mount holding the motor.

As the user pulls on the handle this translates into strain on the motor mount which is measured using a strain gauge in a Wheatstone bridge configuration. In another embodiment, the cable is guided through a pulley coupled to a load cell. In another embodiment, a belt coupling the motor and cable spool or gearbox is guided through a pulley coupled to a load cell. In another embodiment, the resistance generated by the motor is characterized based on the voltage, current, or frequency input to the motor.

In some non-limiting embodiments, Workout apparatus 120 or a connected attachment may use one or more sensors to identify vein patterns, and provide real-time measurements of heart rate, heart rate variability, blood flow, blood pressure, and any other biometrics. Workout apparatus 120 may have one or more infrared (IR) sensors utilizing a high dynamic range to allow for more detailed image capturing of the users movements during exercises.

Workout apparatus 120 may have one or more primary cameras such as primary camera 118 on housing of Workout apparatus 120 whereby primary camera 118 may have one or more lenses, one or more sensors, a photosensitive device, and one or more LED flash lights whereby images and video may be captured. For example, camera 118 may capture pictures or video from a 360-degree field of view which may then be received by control system 210 and transmitted to communication system 230. Cameras 118 may utilize sensors such as a charged-coupled device (CCD) or Complementary Metal-Oxide Semiconductor (CMOS) to sense a captured scene. The sensors in the camera may capture light reflected from the scene taken and translate the strength of that light into a numeric reading by passing light through a number of different color filters whereby the readings are combined and evaluated via software to determine the specific color of each segment of the picture.

Figure 7:
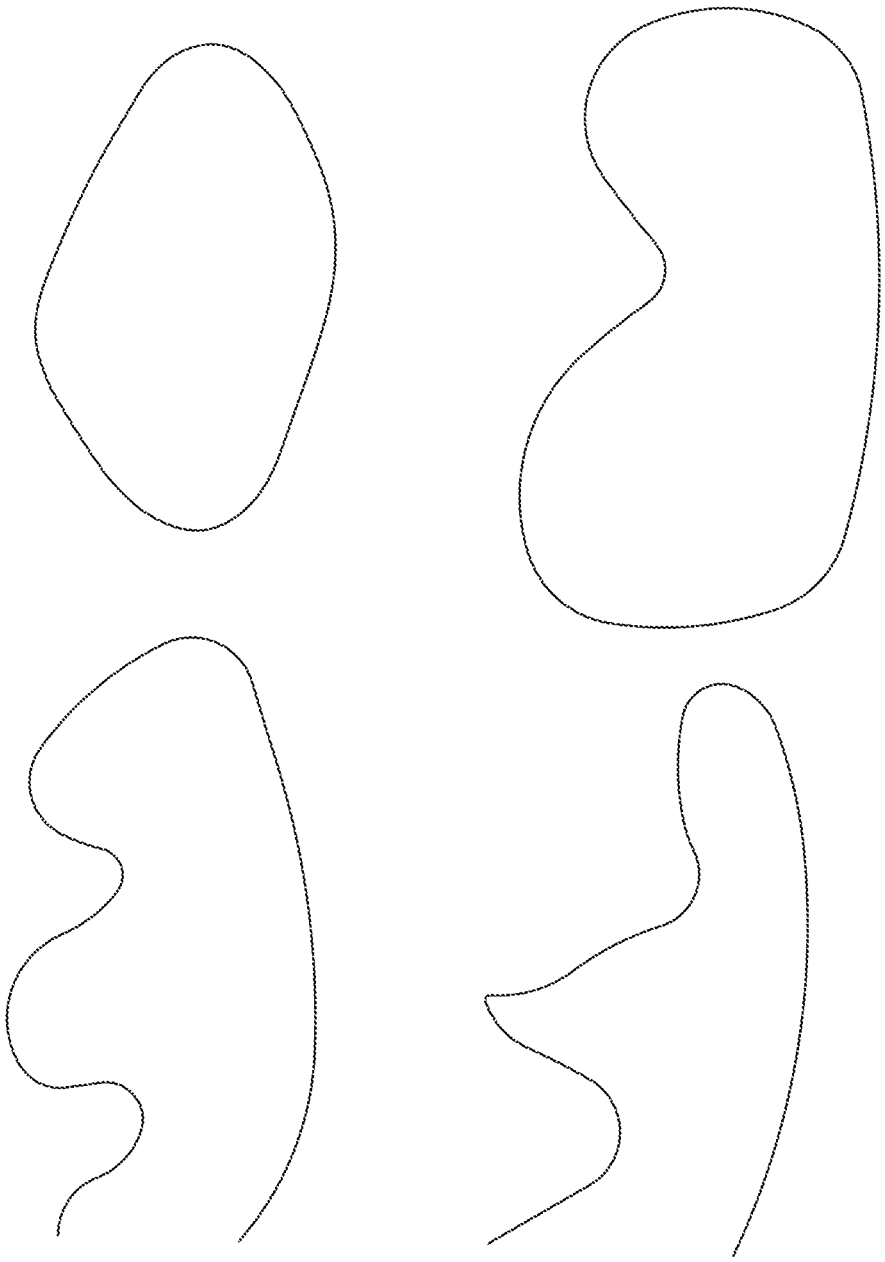
FIG. 7 illustrates the movement of the handle connected to the exercise apparatus.

In some embodiments, control system 230 may compare the location of handle 121 and timestamps of data records recorded while the user is moving handle 121 to stored data of the patterns the user needs to perform while performing exercises with handle 121, as illustrated in FIG. 7. A performance evaluation of the user's exercise may then be generated based on the valuation of the difference in location of where handle 121 was supposed to be during the exercise movement and where handle 121 is during the exercise movement, whereby the error may be scaled based on the difficulty selected by the users. For instance, the users may receive a more favorable score if the location differs a moderate amount on an easy setting mode and a less favorable score on a hard setting mode.

Handle 121 may have a first horizontal portion and a second horizontal section with a vertical portion connecting the first horizontal portion and the second horizontal portion. This has been shaped and designed to provide the benefits of pouring a ladle in metallurgy. The ladle may be rotated anywhere from 45 degree angles and 70 degree angles during use. However, this is non-limiting and may be any degrees. Of course, the more degree options the stronger the muscle groups will become.

Figure 6:
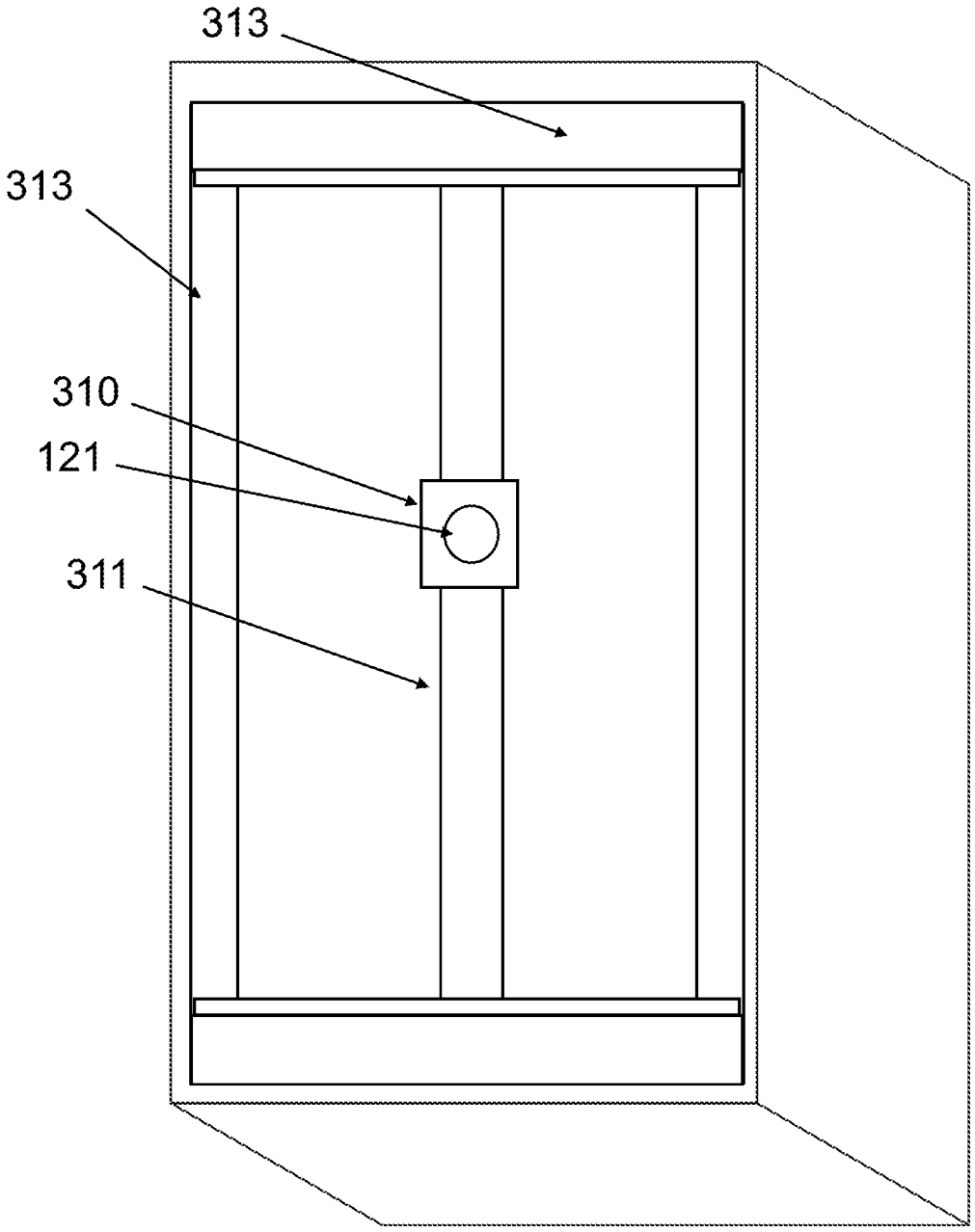
FIG. 6 illustrates the railing system.

Handle 121 may be connected at an opposite end of where the user grabs onto handle to a cartridge 310 positioned inside of workout apparatus 120, as illustrated in FIG. 6 Cartridge 310 may be connected to a vertical pole 311 by any number of fasteners including hinges, latches, or adhesive whereby cartridge 310 is in a sliding engagement with vertical pole 311 such that cartridge 310 may slide in a vertical motion along vertical pole 311. Workout apparatus 120 may include a top end and a bottom end opposite of the top end. Workout apparatus 120 may include a first side end and a second side end opposite of the first side end. One or more base rails 313 may extend between the top end and the bottom end and the side ends to act as support. Vertical pole 311 pole may generally movably be secured to rails 313 along the one or more rails so as to slide between the left side and right side or the top end and bottom end of workout apparatus 120 similar to a three-dimensional smith machine.

One or more bias members may be connected between cartridge 310 and the sides ends (or top and bottom ends) of workout apparatus such that the bias members exert resistance on the carriage as it is moved away from the center of workout apparatus 120 to where the bias members are secured. The bias members may comprise various structures, devices, or the like which provide resistance in one direction of movement, such as resistance springs. The positioning of the bias members will vary depending on the embodiment of the present invention. The bias members may be positioned on the outer sides of the rails or underneath the rails or extend within the rails.

The rails may be assembled together to form a unitized monorail structure as shown in the figures. More specifically, the rails extend substantially the length of the workout apparatus and may be permanently connected to each other using one or more connectors to create a structurally robust monorail structure upon which the carriage may slide.

Handle 121 may be connected to motor system 250 having one or more motors 124 by one or more cables 123. Cables 123 may also be wrapped around a spool 126 rotatably mounted within workout apparatus 120 while a drum may be held in a stationary position within workout apparatus 120 whereby spool 126 may be rotated in a clockwise or counter-clockwise rotation relative to the drum.

Spools 126 may be directly connected to a first motor 124 as well as a second motor 124 that may be positioned opposite of the first motor 124. Motors 124 may have a drive member extending from the motors thereof into contact with spool 126 and directly reciprocate spool 126 within a drum provided in workout apparatus 120 whereby rotational energy produced by motors 124 is converted to clockwise rotating movement around handle 121 by cable 123. Spool 126 may be coupled to motors 124 either directly or via a shaft/belt/chain/gear mechanism. In some embodiments, a gearbox may be positioned between motors 124 and spool 126. Gearboxes multiply torque and/or friction, divide speed, and/or split power to multiple spools. Without changing the fundamentals of digital strength training, a number of combinations of motors and gearboxes may be used to achieve the same end result. A cable-pulley system may be used in place of a gearbox.

In one embodiment, motors 124 may be also coupled to spool 126 via a shaft, gearbox, belt, and/or chain allowing the diameter of the motors and the diameter of the spool to be independent as well as introducing a stage to add a set-up or step-down ratio if desired. Alternatively, the motors 124 is coupled to two spools 126 with an apparatus in between to split or share the power between those two spools 126. Such an apparatus could include a differential gearbox or a pulley configuration.

The movement of cable 123 from motors 124 provides the resistance to handle 121 while the user is moving handle 121 forwards and backwards. This resistance provides the full body exercise system 100 one of the key movements that provides the full body strength while performing movements in the sand. Motors 124 may be attached to the housing of workout apparatus 120 by fasteners such as bolts, latches, screws, or any other fasteners well known to those skilled in the art. Motors 124 may operate by providing a torque that rotates spool 126. During operation, the user is resisting the pull of motors 124 instead of gravity similar to existing cable machines.

During operation, motors 124 is signaled by control system 230 to apply or remove tension to cable 123 based at least in part on the indication of the movement of the user received from sensor system 240. Handle 121 is connected to cable 123 and is physically arranged to deliver a force to the user. Motors 124 may also apply or remove tension to cable 123 in accordance with an exercise program that is presented on control panel 114, which may be transmitted by control system 230.

In one non-limiting embodiment, motors 124 may be, for example, a three-phase brushless DC or induction AC motors driving by the controller circuit. Motors 124 may be connected to a filter to digitally control a controller circuit of control system 230 based on receiving information from handle 121.

If the virtual/perceived movement is moving away from the ground, motors 124 rotates in one direction. If the "weight stack" is moving towards the ground, motors 124 rotates in the opposite direction. Note that motors 124 is pulling towards cable 123 onto spool 126. If cable 123 is unspooling, it is because a user has overpowered motors 124. Thus, note a distinction between the direction the motors is pulling and the direction the motors is actually turning.

If control system 230 is set to drive motors 124 with a constant torque in the direction that spools the cable, corresponding to the same direction as a weight stack being pulled towards the ground, then this translates to a specific force/tension on cable 123 and handle 121. Calling this force "Target Tension," this force may be calculated as a function of torque multiplied by the radius of the spool that the cable is wrapped around, accounting for any additional stages such as gear boxes or belts that may affect the relationship between cable tension and torque. If a user pulls on handle 121 with more force than the Target Tension, then that user overcomes motors 124 and cable 123 unspools moving towards that user, being the virtual equivalent of the weight stack rising. However, if that user applies less tension than the Target Tension, then motors 124 overcomes the user and cable 123 spools onto and move towards motors 124 being the virtual equivalent of the weight stack returning.

In some embodiments, instead of measuring cable tension to calculate velocity, torque may be calculated directly. In order to control torque of motors 124 directly, a series of calculations are made to model the tension on cable 123 of a weight stack moving. In this case, torque/tension is calculated as it is controlled by the controller. The tension on cable 123 of a moving weight stack is not static and varies with the speed/velocity and kinetic energy of the weight stack, which may be calculated by changes in potential energy.

To measure tension on the cable or handle, the "force" on cable 123 or handle 121 needs to be measured. For motor based systems where the cable wraps around spool 126, force may be converted to torque by multiplying the force by the radius of spool 126.

The ramping of weight may additionally be altered based on specific user attributes such as experience lifting a given weight, and/or physical characteristics such as strength assessment or body balance, and/or may be altered based on the specific body positions, movements, or types of movements about to be performed by a user. For example, an S-curve may be different for a bench press versus a lateral pull-down. Digital production alteration of weight is further described in U.S. Pat. No. 11,465,006, which is incorporated by reference.

Figure 2:
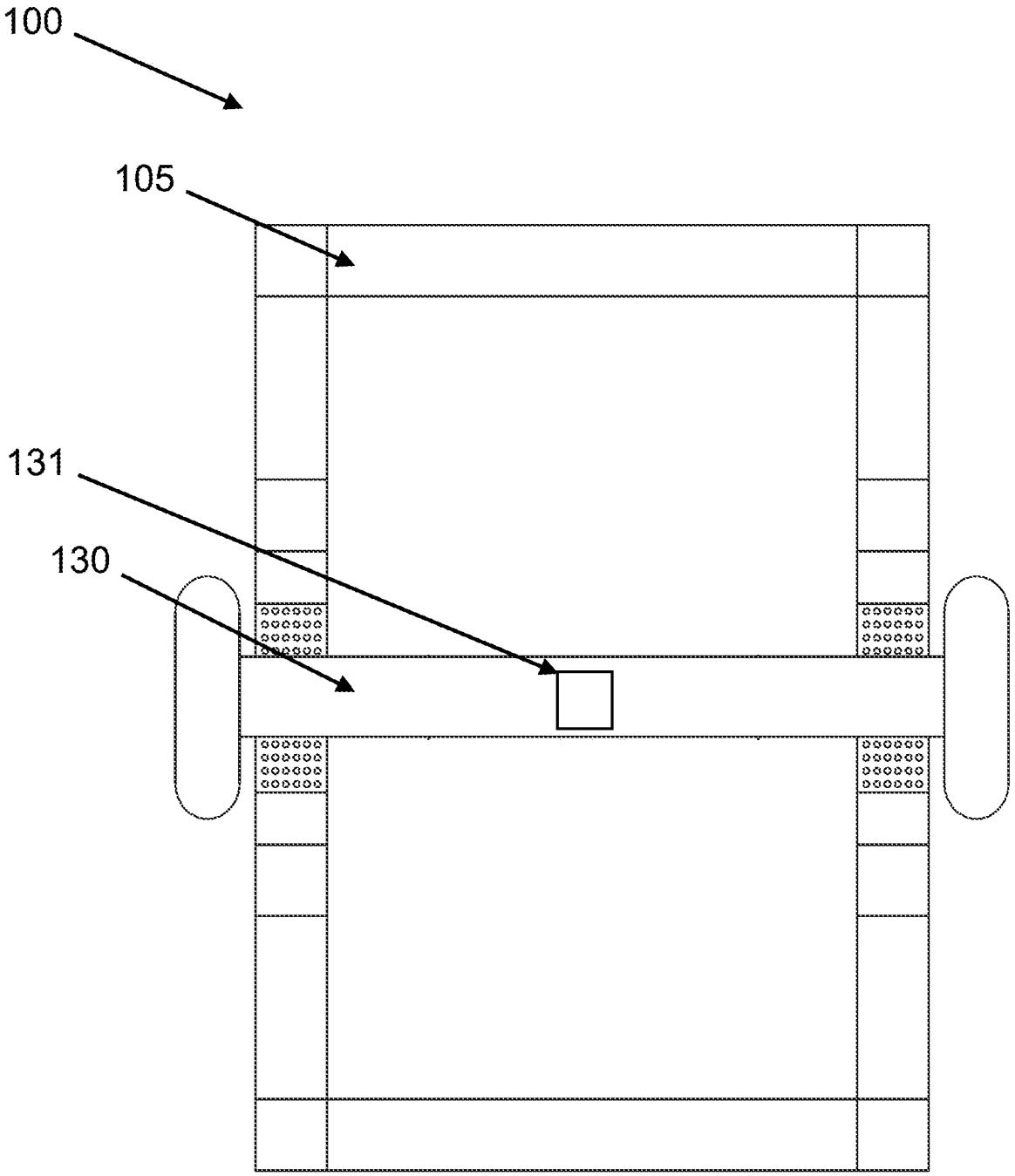
FIG. 2 illustrates a view of a second embodiment of the full body isometric machine.
Figure 3:
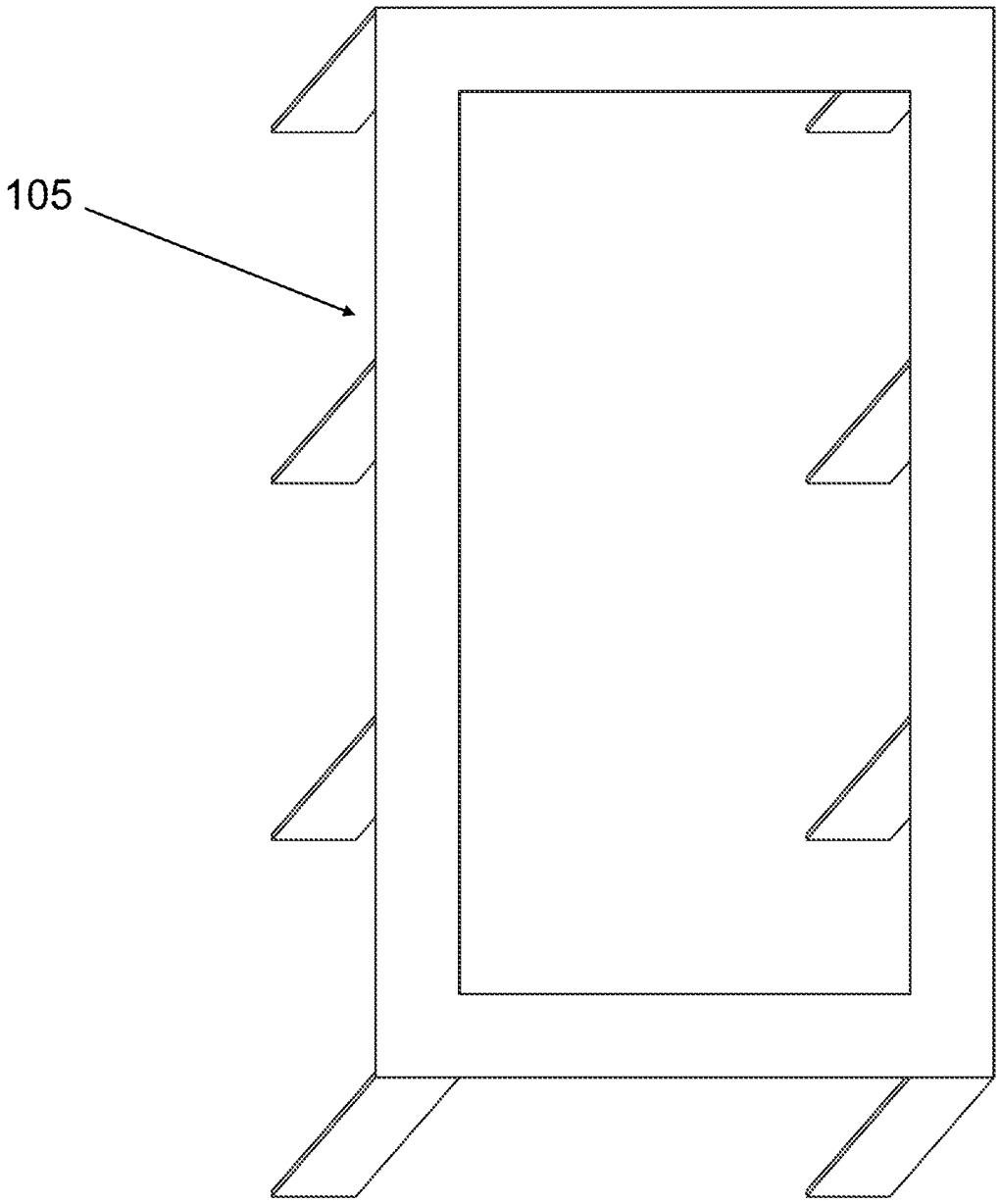
FIG. 3 illustrates a base of the full body isometric machine.

In some embodiments, full body exercise system 100 may have a barbell 130 positioned on the edges of standing platform 105 allowing the user to stand in the sand while pushing and pulling the heavy barbell handle that may have a resistance of 460 lbs to 1,000 lbs, as illustrated in FIG. 2.

Full body exercise system 100 may include one or more metric devices 131 on barbell 130 which may procure and generate data in conjunction with movements of barbell 130. The number of times barbell 130 is moved can be detected and/or calculated and specific outputs can be generated in accordance with the detected and/or calculated data. This can help standardize athletic regimens and produce better fitness results. Generally, when an individual practices, either somebody needs to constantly monitor the person practicing to help them improve or it can be hard to decipher. Additionally, it can be cumbersome for someone to keep track of this data by writing it down or storing it in their mobile device.

Metric device 131 may store and/or generate exercise metrics associated with the exercise equipment including, but not limited to: resistance data, motion data, repetition data, time data, location data, etc. The metric device can also communicate with server 300 or any other wireless network device via Bluetooth, iBeacon (or similar technology), cellular, zig-bee, Wi-Fi, and/or any other wireless communications standard.

Based on data from sensor system 240 (including a motion sensor gyroscope, accelerometer, altimeter, infrared, etc.) of metric device 131, the user may be prompted for tips or live coaching to achieve maximum performance through control panel 114. For example, speed, acceleration, and/or velocity data can be sent from the metric device to the user's mobile device in real-time or near real-time as the user is practicing. Based on the speed, acceleration, and/or velocity data, server 300 may perform a comparison of whether the user is achieving their goals and how to improve. If the user is not achieving their goals, then the control panel 114 may prompt the users 101 to change their actions to achieve the goals. The metric data may be sent to a third party and stored at a server 300 and then pulled down by the third-party's computing device.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An exercise system comprising:

a platform with a cavity, wherein the cavity is configured for holding sand for a user to perform an exercise while standing on the sand;

a workout apparatus having a motor;

a handle that is rotatable; and a cable coupled between the handle and the motor wherein the motor is configured to provide a rotating motion upon the handle to mimic an act of controlling a ladle.

2. The exercise system of claim 1, wherein the handle has a first horizontal portion and a second horizontal portion with a vertical portion connecting the first horizontal portion and the second horizontal portion.

3. The exercise system of claim 1, wherein the motor provides 200 pounds to 400 pounds in resistance.

4. The exercise system of claim 1, wherein the platform is positioned on a plurality of legs for support.

5. The exercise system of claim 4, wherein the platform is divided into two sections on opposite sides.

6. The exercise system of claim 5, wherein the two sections are each a 4' by 5' to 6' area that is 24" to 30" deep filled with the sand.

7. The exercise system of claim 1, further comprising a control system to control the motor, the control system having one or more microprocessors.

8. The exercise system of claim 7, further comprising a sensor system to send signals to the control system.

9. The exercise system of claim 8, wherein the sensor system includes a tension sensor, torque/tension/strain sensor, or a gauge to measure how much tension is being applied to the handle.

10. The exercise system of claim 9, wherein the tension sensor is built into the cable connected to the motor.

11. The exercise system of claim 1, further comprising a display to present a series of movements to be performed.

12. The exercise system of claim 1, further comprising a barbell positioned on sidewalls of the platform.

13. The exercise system of claim 12, wherein the barbell includes one or more metric devices that procure and generate data in conjunction with movements of the barbell.

14. The exercise system of claim 13, wherein the one or more metric devices include a motion sensor gyroscope.

15. An exercise system comprising:

a platform with a cavity, wherein the cavity is configured to hold sand for a user to perform an exercise while standing on the sand;

a workout apparatus having a motor;

a handle that is rotatable connected to a spool which is connected to the motor; and a cable coupled between the handle and the motor wherein the motor is configured to provide a rotating motion upon the handle to mimic an act of controlling a ladle.

16. The exercise system of claim 15, further comprising a display to present a series of patterns to be performed by the user.

17. The exercise system of claim 16, further comprising a control system that performs steps of: comparing a location of the handle and timestamps of data records recorded while the user is moving the handle to stored data of the series of patterns the user needs to perform while performing exercises with the handle.

18. The exercise system of claim 17, wherein the control system further performs the steps of: determining a score based on the comparison.

19. The exercise system of claim 15, wherein the handle is connected to a cartridge that is movable along a pole in a vertical direction.

20. The exercise system of claim 19, wherein the pole is connected to a railing system permitting horizontal movement along a first rail and a second rail.

* * * * *